United States Patent [19]

Tressel

[11] 4,218,951

[45] Aug. 26, 1980

[54] STRINGED INSTRUMENT

[76] Inventor: Willard Tressel, 667 Cragmont Ave., Berkeley, Calif. 94708

[21] Appl. No.: 44,506

[22] Filed: Jun. 1, 1979

[51] Int. Cl.[2] ..... G10D 3/02

[52] U.S. Cl. ..... 84/294; 84/296

[58] Field of Search ..... 84/274–277, 84/294, 296, 309

[56] References Cited

U.S. PATENT DOCUMENTS

| | | | |
|---|---|---|---|
| 563,113 | 6/1896 | Wollenhaupt | 84/294 |
| 1,289,590 | 12/1918 | Young | 84/296 |
| 1,455,916 | 5/1923 | Kalaf | 84/275 X |
| 1,762,617 | 6/1930 | Dopyera | 84/296 |
| 2,089,629 | 8/1937 | Stowe | 84/294 |
| 3,523,479 | 8/1970 | Ludwig | 84/274 |

*Primary Examiner*—Lawrence R. Franklin

*Attorney, Agent, or Firm*—Robert G. Slick

[57] ABSTRACT

A stringed instrument, such as a violin, is provided wherein the bridge of the instrument rests on a resonator bar, and the resonator bar has a plurality of individually-tuned resonators. A pickup, either electronic or acoustic, is coupled to the resonator bar. The output can be purely acoustic or, if an electronic transducer is used, it can be coupled to an amplifier and the output made almost entirely electronic. A mixed electronic and acoustic output can also be obtained. In accordance with one embodiment of the invention, a variable damping feature is provided.

5 Claims, 8 Drawing Figures

STRINGED INSTRUMENT

SUMMARY OF THE INVENTION

The present invention relates to a stringed instrument wherein the strings may be struck, plucked, or bowed. Typical of such instruments is the violin, and the invention will be described in the terms of a violin, although it will be understood that the invention is one of broad applicability and is not limited to violins.

Inexpensive violins completely lack the tonal characteristics and feel of old classic instruments largely because the modern violins, and particularly inexpensive violins, do not have the complexity of harmonic structure characteristic of classical acoustic instruments. Further, such inexpensive violins lack the mechanical behavior or feedback of a classic instrument so that a player of a classical instrument will find that an inexpensive instrument does not feel right in its capacity to absorb his efforts in its mechanical response time.

An object of the present invention is to provide a relatively inexpensive instrument, easily affordable by students, which will have the feel and tonal output of old classical instruments.

Others have tried to achieve such ends but the results have not been fully satisfactory. For instance, U.S. Pat. No. 3,595,981 describes a violin wherein the bridge of the violin is rigidly connected to a spanner which has a number of resonators extending on one side thereof. The resonators are tuned broadly and behave in a multimode manner attempting to cover every semitone. The bars are of low density and therefore of low Q and there is no provision for selective controlled damping of the resonators.

In accordance with the present invention, a bar is supported directly under the bridge of the instrument which has a plurality of resonators thereon. The resonators are tuned to the frequencies which it is desired to enhance. Further, the bridge itself is preferably coupled to the bar which holds the resonators in a unique fashion in that the bridge is mounted on a plate which is supported at the low-frequency side of the bridge on a somewhat resilient support and which is supported on the high-frequency side on a more rigid support. Further, in accordance with a preferred embodiment of the present invention, the resonator bar is supported on the frame of the instrument by a resilient member and the degree of coupling between the bar and the frame can be easily varied to introduce controlled damping into the instrument. This creates a substitute dissipator for the energy not radiated as sound so that the sounds have a naturally rapid rate of decay. Further, the controlled damping provides for a correct mechanical playing behavior or feel and feedback from the load to the bridge which is achieved by providing each foot of the bridge with a correct and separate impedance.

Classical instruments have a limited number of resonant frequencies and the interaction of these resonant frequencies produces a characteristic voice signature of the instrument. In accordance with the present invention, such characteristic voices can be analyzed and the resonators adjusted accordingly to yield a sound closely resembling that of a high-priced classic instrument.

In classical instruments, the bridge is a filter which tends to eliminate unwanted sounds such as finger movements and bow scrape. The desired transverse string oscillations are converted to a pumping action in one foot of the bridge or the other. The undesired noise components are predominantly longitudinal oscillations and are not transferred into such pumping action in a classic instrument, and the instrument of the present invention preserves this relationship.

Thus the present invention solves the two basic problems in stringed instruments, namely the mechanical properties and the tonal properties. Each can be separately adjusted by means of the mounting of the resonators and the selection of the resonators themselves.

In some instruments in the prior art (e.g. U.S. Pat. No. 3,325,580) the bridge rests on a rigid slab of substantial size and the bridge is coupled to the electronic circuit. Such an instrument is devoid of the character or coloration normally associated with fine classical instruments and lacks proper mechanical response.

Thus, according to the present invention, a superior stringed instrument is provided which can be manufactured at a low cost so that it is easily affordable by a student yet has the characteristic feel and tone of fine classical instruments. This is achieved by the unique mounting of the resonators on a bar, which bar is provided with adjustable damping and which is coupled to the bridge of the instrument in a unique fashion. Preferably, this consists of mounting the bridge on a small support plate which is rigidly supported on the high-frequency side of the bridge and resiliently supported on the low-frequency side.

Various other features and advantages of the invention will be brought out in the balance of the specification.

DESCRIPTION OF THE PREFERRED EMBODIMENTS

Figure 1:
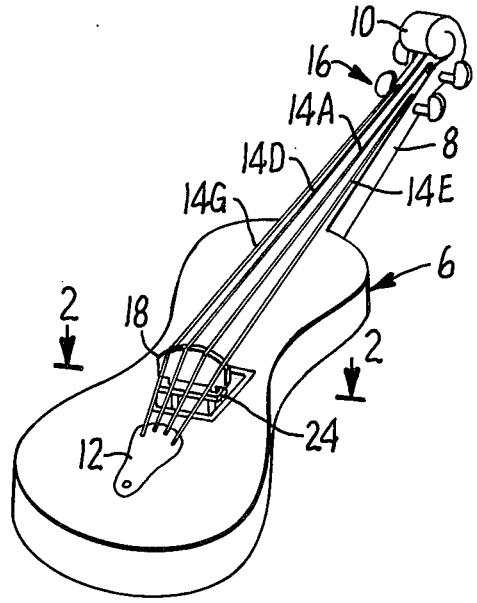
FIG. 1 is a perspective view of a violin embodying the present invention.
Figure 2:
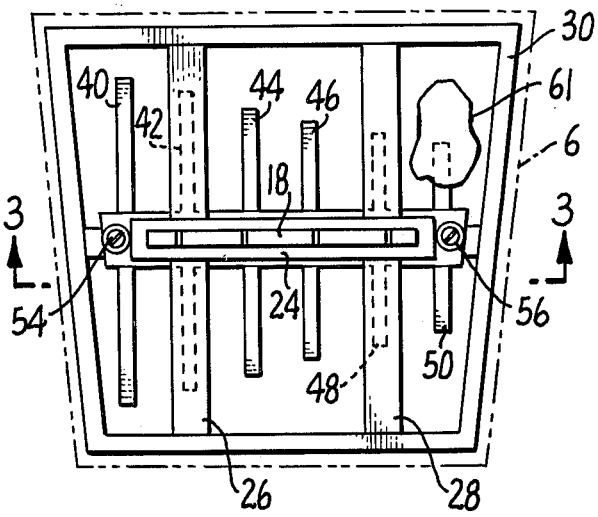
FIG. 2 is an enlarged section on the line 2—2 of FIG. 1.

Referring now to the drawings by reference characters, the violin has a body 6 having a neck 8 terminating in the usual scroll 10. A tail piece or string holder 12 holds one end of the strings, designated 14G, 14D, 14A and 14E while the opposite ends of the strings are connected to the usual pegs 16. The strings all pass over the bridge 18. It will be noted that the violin is made in the classic shape but, if acoustic output is not to be obtained from the violin, this is not necessary. In fact, it will be noted that the usual sound holes are completely lacking. The bridge 18 has two feet 20 and 22 and these rest on a small plate 24 which is spaced from the body of the instrument 6. The plate 22 is supported on two longitudinal bars 26 and 28 which are attached to a frame member 30 connected to the body 6 of the instrument. It should be noted that the mounting is not symmetrical, the support 28 being directly connected to plate 24 while the support 26 is connected to the plate 24 through a dissipative pad 32. The dissipative pad 32 is under the low-frequency side of the bridge and provides a correct impedance match between the plate 24 and the support, whereby the high-frequency side of the bridge is more restrained than the low-frequency side, putting its passband of frequency response in a higher range beginning at 440 Hz.

Plate 24 is connected to the transverse resonance bar 34 by means of posts 36 and 38. The transverse resonance bar 34 has a plurality of resonators extending on each side thereof, the resonators being designated 40, 42, 44, 46, 48, and 50. The transverse resonator bar 34 is mounted on a frame element 52, which is adjustably fastened to the frame element 30 by means of screws 54 and 56 each of which has a damping pad 58 and 60 mounted on each side of the resonator bar. Thus, it is easy to adjust the damping to provide for a desired degree of resonance and the most desirable approach to the mechanical action and tone of a classic instrument.

Directly under the resonance bar 34 and connected thereto is a pin 62 which is connected to a transducer 64. Wire 66 connects the transducer to the usual amplifier and output as shown in FIG. 7.

In addition to the damping adjustment, a web of resilient material 61 can be placed over the resonators or coated on each individual stem to give control of the Q of the bar resonator, allowing control over the peakiness of the bar responses.

Figure 6:
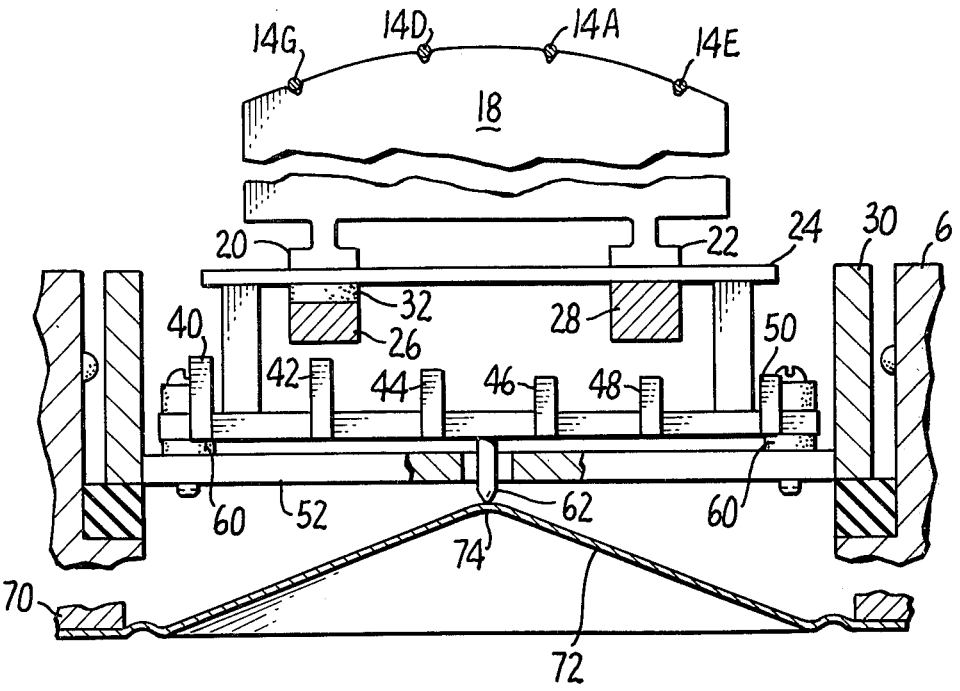
FIG. 6 is a sectional view, similar to FIG. 3, showing an acoustic coupling.

Although the instrument of the present invention was primarily designed for use with an electric pickup, it is possible to obtain the benefit of the resonance enhancing system of the present invention with an acoustic output. Thus, referring to FIG. 6, all of the parts are the same as in FIG. 3 except for the output. In this embodiment of the invention the body of the instrument, designated 70, is cut out and provided with a vibrating cone 72 similar to the cone of a typical loudspeaker, or, alternatively, a thin flat plate. The one portion of the cone, normally the center 74, is attached to the pin 62. Thus, unlike FIG. 3 wherein pin 62 actuates an electronic transducer, in this embodiment, the pin directly actuates the cone, providing an acoustic output for the instrument.

Figure 3:
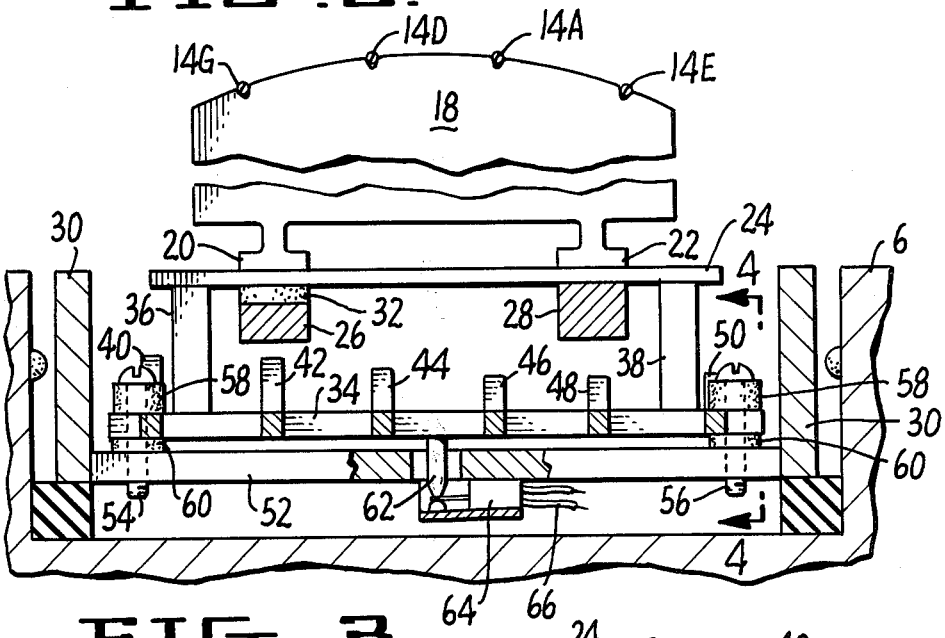
FIG. 3 is an enlarged section on the line 3—3 of FIG. 2.
Figure 4:
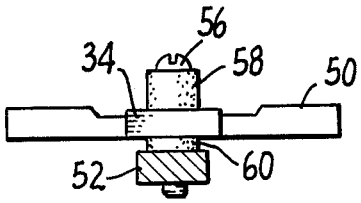
FIG. 4 is a section on the line 4—4 of FIG. 3.
Figure 5:
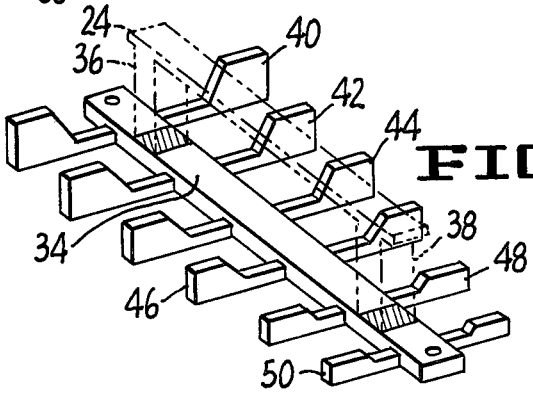
FIG. 5 is a perspective view of the transverse resonator support bar and resonators.
Figure 7:
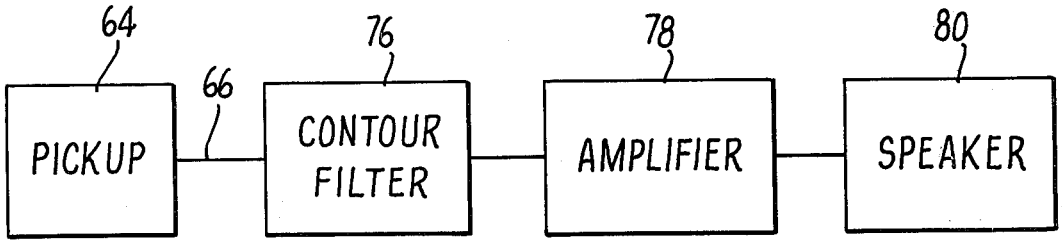
FIG. 7 is a block diagram of an electronic system for employing an electronic output from an instrument.
Figure 8:
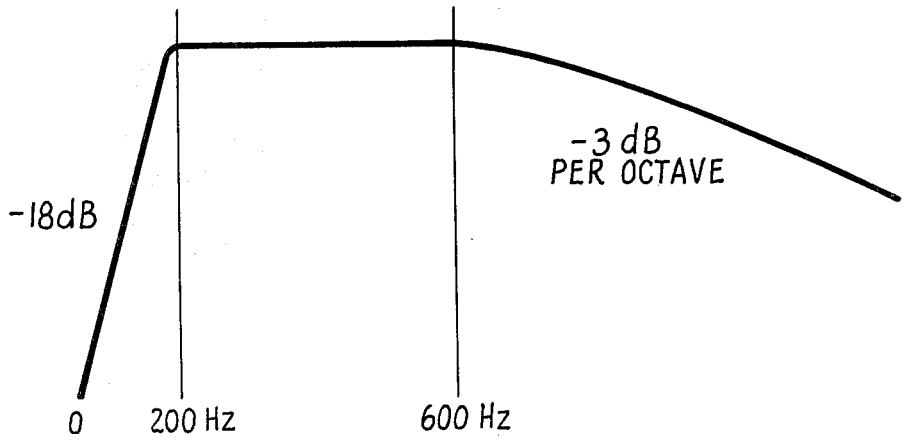
FIG. 8 is a frequency response curve plotting a typical frequency against volume relationship.

In FIG. 7 a block diagram is shown of a typical electronic output. The pickup 64 having output wiring 66, previously described in connection with FIG. 3, is connected to a contour filter 76. The contour filter has the property of attenuating very low frequencies to prevent amplification of normally unheard combination tones and rumbling noises and has a fall off above 600 Hz of about 3 dB per octave, with a substantially flat response from 200 Hz to 600 Hz in the case of a violin. This is shown graphically in FIG. 8. This is a tyical filter circuit and the response would be changed depending upon the particular instrument employed.

The output of the contour filter 76 goes to an audio amplifier 78 and drives one or more speakers 80. This provides an electronic output for the instrument.

In a practical embodiment of the invention, the resonators and the bar supporting the resonators are made of a heavy, dense wood such as maple or rosewood. This give a high Q which is highly desirable. Other materials which give a high Q such as other dense wood, epoxy resin, and carbon fiber filled epoxy resin are suitable, both for the resonator bar and the resonator elements themselves.

In one practical embodiment of the invention, the resonator bars 40, 42, 44, 46, 48 and 50 were tuned to the frequencies 220; 349; 482; 440; 1,000, and 2,000 Hz. The masses were adjusted according to the contribution which was required from each one. In practice, each end of the bars is tuned slightly differently to widen resonant response. This, of course, is merely for purposes of illustration and would be suitable only for a violin. Other instruments of the string type would naturally require other selections of frequencies.

I claim:

1. A stringed instrument wherein said instrument has the usual configuration including a plurality of strings held in tension over a bridge, said strings being adapted to be struck, plucked or bowed, comprising in combination:

a. a small plate supporting a bridge, said bridge having a pair of feet resting on said plate;

b. a pair of longitudinal bars placed under said plate substantially under said feet, said longitudinal bars being connected to a frame member on the instrument to support said plate and said bridge;

c. a transverse resonator support bar mounted under said plate and said bridge and supported by, but spaced from, said plate;

d. a plurality of resonator bars extending at right angles from said resonator support bar, and e. pickup means coupled to said resonator support bar.

2. The instrument of claim 1 wherein an electronic pickup means is employed.

3. The instrument of claim 1 wherein an acoustic pickup means is employed.

4. The instrument of claim 1 wherein the resonator bars are made of a dense material having a high Q selected from dense wood, epoxy resin and carbon fiber filled epoxy resin.

5. The stringed instrument of claim 1 wherein the low-frequency side of the bridge is mounted on a somewhat resilient support and the high-frequency side of the bridge is mounted on a more rigid support.

* * * * *